US006748712B2

(12) United States Patent
Likozar et al.

(10) Patent No.: US 6,748,712 B2
(45) Date of Patent: Jun. 15, 2004

(54) SCALABLE SUSPENSION SYSTEM FOR DOME SHAPED CEILINGS

(75) Inventors: Martin E. Likozar, Richmond Heights, OH (US); James A. Fletterick, Olmstead Falls, OH (US); Alan C. Wendt, Barrington, IL (US); David B. Lewis, Orlando, FL (US)

(73) Assignee: USG Interiors, Inc., Chicago, IL (US)

( * ) Notice: Subject to any disclaimer, the term of this patent is extended or adjusted under 35 U.S.C. 154(b) by 0 days.

(21) Appl. No.: 10/171,726

(22) Filed: Jun. 14, 2002

(65) Prior Publication Data

US 2003/0230043 A1 Dec. 18, 2003

(51) Int. Cl.[7] ..... E04B 2/00; E04B 7/08
(52) U.S. Cl. ..... 52/506.07; 52/81.2; 52/81.3
(58) Field of Search ..... 52/506.07, 81.2, 52/81.3, 83

(56) References Cited

U.S. PATENT DOCUMENTS

| | | | | |
|---|---|---|---|---|
| 3,462,893 A | * | 8/1969 | Kaiser | 52/80.1 |
| 3,488,901 A | * | 1/1970 | Peterschmidt | 52/81.1 |
| 3,703,307 A | * | 11/1972 | Curtis | |
| 3,888,056 A | * | 6/1975 | Kelly et al. | 52/109 |
| 4,262,461 A | * | 4/1981 | Johnson et al. | 52/81.1 |
| 4,442,639 A | * | 4/1984 | Lindsey et al. | 52/73 |
| 4,491,437 A | * | 1/1985 | Schwartz | 403/172 |
| 4,663,898 A | * | 5/1987 | Yacaboni | 52/82 |
| 4,698,941 A | * | 10/1987 | Rieder, deceased et al. | 52/81.1 |
| 4,729,197 A | | 3/1988 | Miller | |
| 4,981,732 A | | 1/1991 | Hoberman | |
| 5,031,371 A | | 7/1991 | Davister | |
| 5,130,915 A | * | 7/1992 | Lerch | 362/367 |
| 5,377,460 A | | 1/1995 | Hicks | |
| 5,699,641 A | * | 12/1997 | Tinen et al. | 52/506.07 |
| 5,815,990 A | * | 10/1998 | Barry et al. | 52/80.1 |
| 6,276,095 B1 | * | 8/2001 | Tripsianes | 52/81.1 |
| 6,360,496 B1 | | 3/2002 | Raccuglia | |

FOREIGN PATENT DOCUMENTS

| | | |
|---|---|---|
| JP | 11-62003 | 3/1999 |

* cited by examiner

*Primary Examiner*—Anita King
(74) *Attorney, Agent, or Firm*—Barnes & Thornburg; John M. Lorenzen; David F. Janci

(57) ABSTRACT

The present invention relates to a scalable suspension system for domed shaped ceilings that includes a framework of suspension members interconnected to a central hub. The framework of suspension members are used to support a domed shaped ceiling fabricated from plaster or gypsum wallboard. The suspension members include primary spoke members, secondary spoke members, intercostal members and cross tees. The primary spoke members are attached to the central hub component. The intercostal members are spanned between the primary spoke members. The secondary spoke members are connected to the intercostal members, and extend between the primary spoke members. The primary and secondary spoke members are interconnected by the cross tees to create a unified structure. The hub includes radially indexed integral tabs that facilitate the attachment of the hanger wires and allows for the rigid attachment of the primary spoke members in a precise radial pattern.

32 Claims, 3 Drawing Sheets

SCALABLE SUSPENSION SYSTEM FOR DOME SHAPED CEILINGS

BACKGROUND OF THE INVENTION

This invention relates generally to drywall suspension systems and more particularly to a novel and improved system for creating domed ceilings using suspension members that include primary and secondary curved spoke members interconnected by using a central hub and intercostal members so that a domed shaped ceiling can be created.

Domed ceilings are common architectural elements. Small domes are available in prefabricated forms. Prefabricated domes such as those produced from glass-reinforced gypsum are relatively easy to erect but are fragile, heavy and difficult to handle. Further, such domes are available only in incremental sizes and generally are less than ten feet in diameter.

Larger domes are usually built using conventional ceiling materials. Constructing a dome with these materials is much more labor intensive than constructing a flat ceiling because they pose special challenges to the installer. Most of these challenges deal with the planning, constructing and gauging of an accurate support system to which finishes may be attached. Often, these support systems are constructed without pre-engineered components in an ad hoc fashion such as crude assemblies of wood or roughly bent metal parts. Metal suspension tees have also been modified to form dome suspension frames. The tees are modified to form rough curves by cutting slits incrementally along the length of the tee, hand bending the tee against a template, and applying mending plates across the slots. The modified tees are attached to a center point and suspended in a radial pattern. The position of the radial tees is indexed by inserting short straight sections of tees.

The fabrication and assembly processes of on-site fabricated ceilings are labor intensive. Further, the process results in a surface composed of many discontinuous straight segments and a central region that is overcrowded with tees and hanger wires. Such a crowded number of tees and hanger wires interconnected in a small area presents installation problems and is generally considered an inefficient use of materials. Once the support system is fabricated and assembled, domed ceilings are typically finished using a lath and plaster system or drywall with joint treatment. The amount of labor and material required to form smoothly curved surfaces of these types is greatly affected by the accuracy of the underlying curved support system. If the support system is not accurately curved, large amounts of plaster or joint compound must be applied and sanded to achieve the desired smoothness. Prior art systems do not provide for an accurately curved domed support system that provides for easy on-site assembly and installation.

SUMMARY OF THE INVENTION

This invention may be described as a novel and improved scalable suspension system for domed shaped ceilings that includes a framework of suspension members interconnected to a central hub. The framework of suspension members are used to support a domed shaped ceiling fabricated from plaster or gypsum wallboard. The framework is scalable in that it can be dimensioned to accommodate domes of various diameters. All of the suspension members are curved to the same radius and when assembled, trace the surface of a sphere with the same radius. If the suspension system is not a perfect hemispherical dome, the suspension members may have different radii of curvature. The suspension members include primary spoke members, secondary spoke members, intercostal members and cross tees. The primary spoke members are attached to the central hub component. The intercostal members are spanned between the primary spoke members. The secondary spoke members are connected to the intercostal members, which extend between the primary spoke members. The primary and secondary spoke members are interconnected by the cross tee's to create a unified structure. The hub includes radially indexed integral tabs that facilitate the attachment of the hanger wires and allows for the rigid attachment of the primary spoke members in a precise radial pattern.

These and other aspects of this invention are illustrated in the accompanying drawings, and are more fully described in the following specification

DETAILED DESCRIPTION OF THE INVENTION

While the present invention will be described fully hereinafter with reference to the accompanying drawings, in which a particular embodiment is shown, it is understood at the outset that persons skilled in the art may modify the invention herein described while still achieving the desired result of this invention. Accordingly, the description that follows is to be understood as a broad informative disclosure directed to persons skilled in the appropriate arts and not as limitations of the present invention as claimed.

Figure 1:
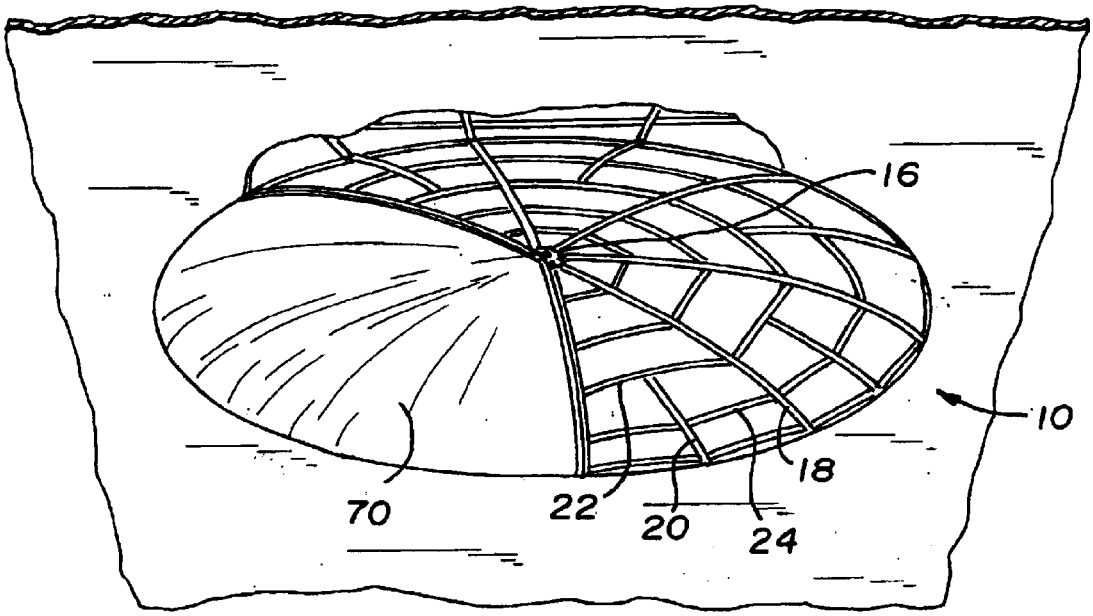
FIG. 1 is a bottom perspective view of a scalable suspension system for domed shaped ceilings of the present invention with a section of wallboard removed.
Figure 2:
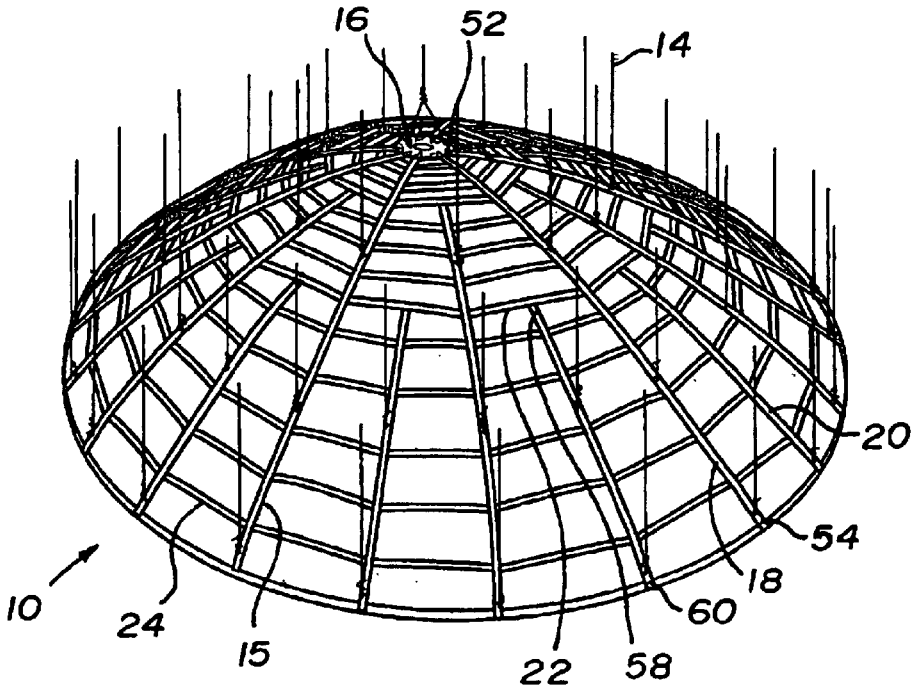
FIG. 2 is a top perspective view of the scalable suspension system view from above, illustrating the framework of suspension members and hanger wires.

The present invention is directed to a scalable suspension system used to create dome shaped ceilings. While dome shaped ceilings are discussed, other shapes can be produced such as cones and other conic shapes, such as a parabola. The suspension system 10 is adapted to be suspended from a building structure by using hanger wires or rods 14 as shown in FIGS. 1 and 2. The suspension system 10 includes a central hub 16, and curved structural members 15 that are used to create primary spoke members 18, secondary spoke members 20, intercostal members 22 and cross tees 24.

Figure 3:
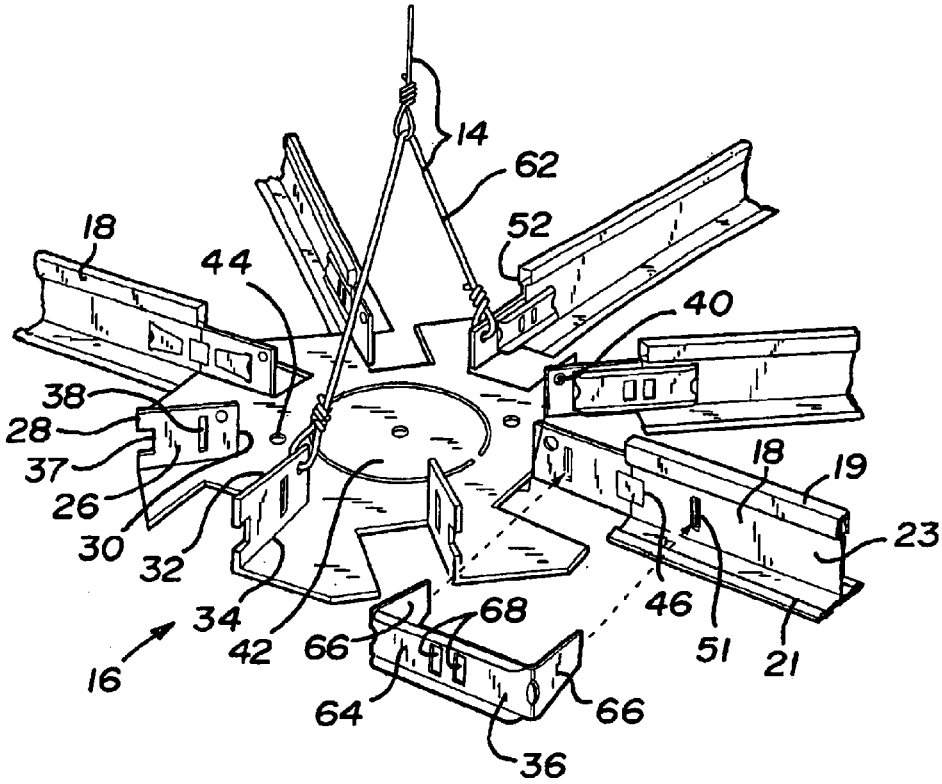
FIG. 3 is a perspective view of the hub illustrating the connection of the hub to the primary spoke members.

The central hub 16 is a metallic plate member that is designed to be connected to the primary spoke members 18 as shown in FIG. 3. The central hub 16 includes a plurality of radially indexed integral tabs 26 positioned at predetermined angles that facilitate the attachment of the hanger wires 14 to allow the hub 16 to be supported from the building structure. The tabs 26 also act as primary member 18 attachment points and provides for a rigid connection. The hub essentially forces the primary spoke members 18 to be oriented coplaner with the hub. The tabs include a front edge 28, a rear edge 30, a first side edge 32 and a second side edge 34. The tabs 26 are formed by cutting the hub plate 16 along the first side edge 32 and rear edge 30 of the tab 26. The tabs 26 are then bent upward from the hub 16 along the second side edge 34 so that the tab 26 is generally perpendicular to the hub 16. The tabs 26 create a moment connection with the primary spoke members 18 to allow the primary spoke members 18 to be suspended in a precise radial pattern. The tabs 26 include notches 37 located along the front edge 28 and a substantially vertical slot 38 both of which are adapted to accept a splice plate 36. The connection formed between the tabs 26 and the primary spoke members 18 is rigid, preventing the spokes from twisting out of position. This arrangement creates a continuous arc through the radius of curvature of two opposing primary spoke members 18, creating a uniform arc structure. The tabs 26 further include an aperture 40 that is adapted to accept the hanger wire 14 to allow the hub to be suspended from the building structure. The hub 16 in the preferred embodiment includes eight tabs 26 each equally spaced around the hub 16.

Located at the center of the hub 16 is an electrical knockout 42 that is adapted to allow for easy on-site removal to allow for the passage of sprinkler heads or electrical wiring for light fixtures and other electrical devices. The hub also includes a plurality of apertures 44 surrounding the knockout 42. The apertures 44 allow for the passage of fasteners, which permits the attachment of an electrical box (not shown).

Figure 4:
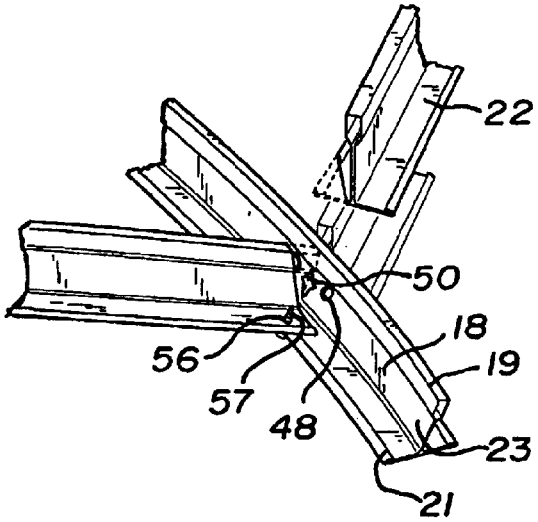
FIG. 4 is a perspective view of the scalable suspension system illustrating the interconnection of the intercostal members to the primary spoke members.
Figure 6:
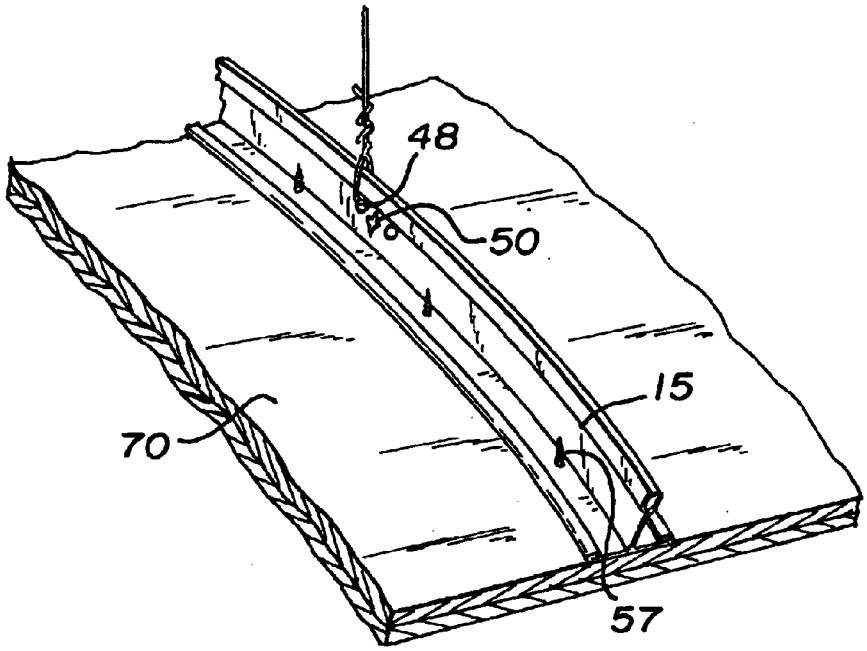
FIG. 6 is a perspective view of the scalable suspension system illustrating the connection of wallboard to a suspension member.

The structural members 15, make up the primary spoke members 18, secondary spoke members 20, and are shortened to create the intercostal members 22 and cross tees 24, as shown in FIG. 2. The structural members 15 are roll formed tees that are factory curved to a specified radius. The ends of the primary spoke members 18 are punched to form notches 46, which are sized to accept the splice plate 36, as shown in FIG. 3. A repeating pattern of two apertures 48 and a vertical slot 50 is punched at exact increments along the length of each of the structural members 15, as shown in FIGS. 4 and 6. The vertical slots 50 aid in the construction process because they mark locations where most of the intercostal 22 and cross tee 24 member intersections will occur. Further, the vertical slots 50 provide a visual gauge of distance along the structural members 15 thereby reducing the number of exact measurements that need to be made during construction. The apertures 48, allow for the attachment of the hanger wires 14. It has been found that one hanger wire 14 positioned every twelve square feet provides proper support for the ceiling system 10 that uses a double layer of gypsum board or a lath and plaster arrangement. Additional apertures 48 are provided so that the installer has the ability to work around potential obstructions on the host ceiling of the building structure.

The primary spoke members 18 are structural members 15 curved to an exact radius, so that field forming is not required. The primary members 18 include a bulb portion 19, a base portion 21 and a bridge portion 23 as shown in FIGS. 3 and 4. The primary spoke members 18 are attached to the hub 16 at a first end 52 and terminate at the perimeter of the scalable ceiling system 10 at a second end 54. Depending on the conic shape of the ceiling system 10, the primary spoke members 18 will be curved to fit the system. Also, depending upon the size of the dome, the primary spoke members 18 may be a single structural member 15 or an assembly of several structural members 15. End to end connections of the primary spoke members 18 are made by using the splice plates 36. The primary spoke members 18 are connected to the hub 16 by aligning the notch 46 located on the first end 52 of the primary spoke member 18 with the notch 37 located on the front edge 28 of the tabs 26 and connecting the splice plate 36 to form a rigid connection between the hub 16 and the primary spoke member 18.

The intercostal members 22 are cut from the curved structural members 15. The maximum span between the primary spoke members 18 is typically forty-eight inches. The intercostal members 22 are inserted between two primary spoke members 18 where they diverge by a distance of forty eight inches or less to maintain structural integrity of the system as shown in FIG. 4. The intercostal members 22 are prepared by cutting the structural members 15 and positioning them at a slot 50 located along the length of the primary spoke members 18. The ends of the intercostal members 22 may need to be trimmed in order to be properly positioned between the primary spoke members 18 as shown by the hidden lines in FIGS. 6 and 7. Once the intercostal members 22 are properly positioned, holes 56 are drilled through the intercostal member 22 and base portion 21 of the primary spoke member 18 and an ordinary mechanical fastener 57 is inserted, creating a rigid connection. Also, self tapping screws can be used to create the connection between the intercostal member 22 and the primary spoke member 18.

Figure 5:
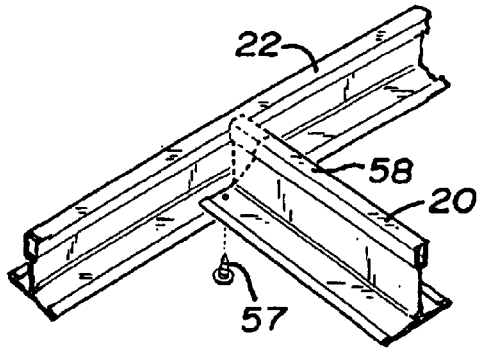
FIG. 5 is perspective view of the scalable suspension system illustrating the interconnection of the secondary spoke members to the intercoastal members.

The secondary spoke members 20, best shown in FIG. 1, are fabricated from a section of the structural members 15. The secondary spoke members 20 are similar to the primary spoke members 18 except that they are not attached to the hub 16. Instead, the secondary spoke members 20 are attached at a first end 58 to the midpoint of the intercostal members 22 using the ordinary mechanical fasteners 57 and have a second end 60 that terminates at the perimeter of the scalable ceiling system 10 as shown in FIGS. 2 and 5. Depending upon the size of the dome, the secondary spoke members may be a single structural member 15 or an assembly of several structural members 15. On smaller domes, secondary spoke members 20 and intercostal members 22 are not used. End to end connections of the secondary spoke members 20 are made by using the splice plates 36. Generally, the amount of members in a set of secondary spoke members 20 and a set of intercostal members 22 is equal to the number or primary spoke members 18 when forming the ceiling system 10. Depending upon the size of the dome, several sets of secondary spoke members 20 and intercostal members 22 may be necessary in order to obtain a rigid dome structure.

The cross tees 24 are cut from the curved structural members 15 and are relatively short sections spanning twenty four to forty-eight inches with a maximum span of forty-eight inches to maintain the structural integrity of the system 10. Both ends of each cross tee 24 are attached to adjacent spoke members 18 and 20 using ordinary mechanical fasteners, as shown in FIG. 2.

To install the scalable ceiling system 10 the location and elevation for the center or apex of the dome is located for the hanging of the hub 16. Once the center is located, the hub 16 is suspended by creating a yoke 62 out of the hanger wire 14 and suspending the yoke 62 between two opposite apertures 40 located on the tabs 26. Hanger wire 14 is then used to suspend the yoke 62 from the building structure. Once the hub 16 is suspended, the first ends 52 of the primary spoke members 18 are aligned with the front edges 28 of the tabs 26 as shown in FIG. 3. Once the primary spoke members 18 are aligned with the tabs 26 of the hub 16, splice plates 36 are used to interconnect the primary spoke members 18 and the tabs 26. The splice plates 36 include a main body portion 64 that includes two outwardly extending clasps 66 and central retainer tabs 68. The central retainer tabs 68 are adapted to interconnect the notch 37 on the tab 26 to the notch 46 on the primary spoke members 18. The clasps 66 of the splice plate 36 are inserted into the slot 38 in the tabs 26 and the slots 51 of the primary grid members 18 and folded inwardly to lock the primary grid members 18 to the tabs 26 of the hub 16. The primary spoke members 18 are suspended from the building structure by using the hanger wires 14. The spacing between hanger wires 14 is varied depending upon where they are connected to the dome. The hanger wires 14 located near the perimeter of the dome are spaced closer together than the hanger wires 14 located near the center of the dome due to the added span between the structural members 15 resulting in an increase in dome surface area and load. Once the primary spoke members 18 are connected to the hub 16 and suspended to the building structure, the intercostal members 22 are positioned between the primary spoke members 18 and fastened together. With the intercostal members 22 in position, the secondary spoke members 20 are positioned between the primary spoke members 18 and connected to the intercostal members 22. Additional intercostal members 22 and secondary spoke members 20 may be required depending upon the diameter of the dome. Once the secondary spoke members 20 are properly fastened into position, cross tees 24 are spanned between and fastened to the primary and secondary spoke members 18 and 20. The primary purpose of the cross tees 24 is to provide a surface for the attachment of gypsum panels 70, or lath 72 and plaster 74, as shown in FIGS. 6 and 7 respectively.

Figure 7:
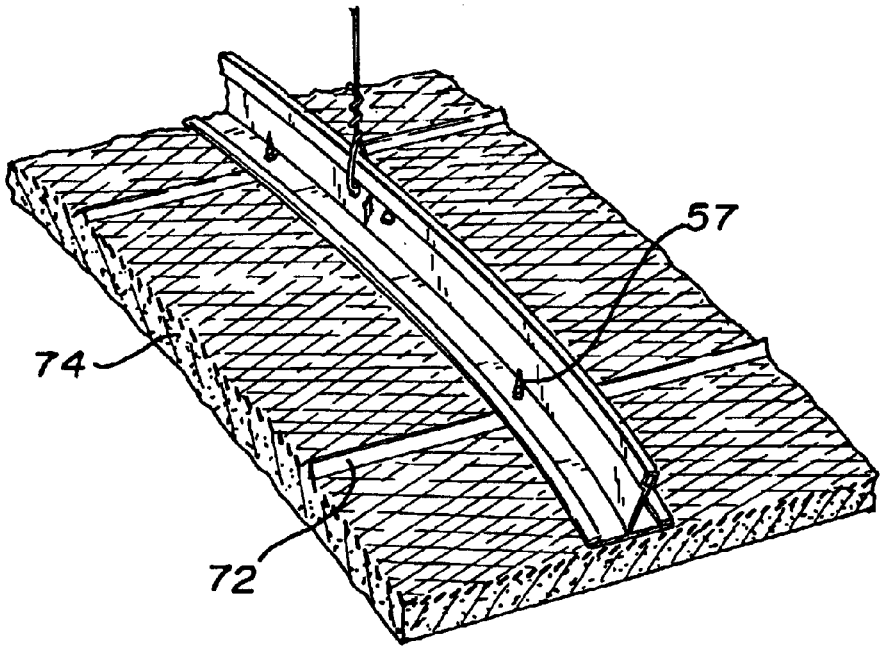
FIG. 7 is a perspective view of the scalable suspension system illustrating the connection of metal lath and plaster to a suspension member.

The ceiling system 10 can be finished by using a lath 72 and a plaster 74 arrangement wherein the lath 72 is fastened to the structural members 15 with ordinary mechanical fasteners 57 as shown in FIG. 7. Once the lath 72 is secured to the structural members 15 a mixture of plaster and sand is applied to the lath 72 at a thickness of approximately ⅝". Once the basecoat plaster and sand mixture has cured, a final coat of finish plaster is applied, and once dry, sanded for smoothness. The ceiling system 10 can also be finished by applying gypsum panels 70 in single or multiple layers to the primary spoke members 18, secondary spoke members 20, intercostal members 22 and cross tees 24 by using standard mechanical fasteners 57, as shown in FIG. 6. The gypsum board 70 is typically a four foot by eight foot sheet with an overall thickness from one quarter of an inch to about three eighths of an inch. Once the gypsum board 70 is installed to the structural members 15, the seams between panels are taped and sanded smooth. Once the finish is applied, the ceiling system 10 can be painted as desired.

Various features of the invention have been particularly shown and described in connection with the illustrated embodiment of the invention, however, it must be understood that these particular arrangements merely illustrate, and that the invention is to be given its fullest interpretation within the terms of the appended claims.

What is claimed is:

1. A domed ceiling suspension system for creating dome shaped ceilings comprising:

a central hub adapted to be suspended from a building structure, said hub including a plurality of radially indexed tabs extending outwardly from said hub;

a plurality of primary spoke members curved along their length and being connected to said tabs of said hub at a first end and terminating at the perimeter of said suspension system at a second end, said plurality of primary spoke members adapted to be suspended from the building structure;

a plurality of intercostal members spanning between said plurality of primary spoke members and connected thereto;

a plurality of secondary spoke members curved along their length and being connected to said intercostal members at a first end and terminating at the perimeter of said suspension system at a second end, said plurality of secondary spoke members adapted to be suspended from the building structure; and at least one cross tee extending from one of said plurality of primary spoke members to a second of said plurality of primary spoke members and at least one cross tee extending from one of said plurality of primary spoke members to one of said plurality of secondary spoke members.

2. The domed ceiling suspension system of claim 1, wherein said ceiling suspension system further includes a plurality of splice plates adapted to connect said hub with said primary spoke members.

3. The domed ceiling suspension system of claim 2, wherein said splice plates allow for the interconnection of multiple primary spoke members.

4. The domed ceiling suspension system of claim 1, wherein said plurality of intercostal members are curved along their length and are connected to said plurality of primary spoke members by use of fasteners.

5. The domed ceiling suspension system of claim 1, wherein said first ends of said plurality of secondary spoke members are connected to the midpoint of said plurality of intercostal members by use of fasteners.

6. The domed ceiling suspension system of claim 1, wherein said plurality of cross tees are curved along their length and are connected between said plurality of primary spoke members and between said plurality of secondary spoke members and said primary spoke members by use of fasteners.

7. The domed ceiling suspension system of claim 1, further including a plaster layer connected to said plurality of primary spoke members, secondary spoke members, intercostal members, cross tees and hub to form a uniform domed surface.

8. The domed ceiling suspension system of claim 2, wherein said tabs of said hub include a slot adapted to accept said splice plates.

9. The domed ceiling suspension system of claim 1, wherein said hub includes a knockout adapted to allow for the passage of utility components.

10. The domed ceiling suspension system of claim 1, wherein said tabs of said hub include an aperture adapted to accept hanger wire.

11. The dome ceiling suspension system of claim 7, wherein said plurality of primary spoke members, secondary spoke members, intercostal members, cross tees and hub include a surface to allow for the attachment of said plaster layer.

12. A domed suspended ceiling structure comprising:

a central hub adapted to be suspended from a building structure and including a plurality of radially indexed tabs;

a plurality of primary spoke members at least a portion of which are curved, said plurality of primary spoke members are connected to said tabs of said hub;

a plurality of intercostal members at least a portion of which are curved, said plurality of intercostal members oriented to span between said plurality of primary spoke members and adapted to be fastened thereto;

a plurality of secondary spoke members, at least a portion of which are curved, said plurality of secondary spoke members are positioned between said plurality of primary spoke members and connected to said plurality of intercostal members; and a finishing layer attached to said plurality of primary spoke members, secondary spoke members and intercostal members to create a continuous domed surface.

13. The domed suspended ceiling structure of claim 12, further including a plurality of splice plates adapted to connect said hub with said primary spoke members.

14. The domed suspended ceiling structure of claim 13, wherein said splice plates allow for the interconnection of multiple primary spoke members.

15. The domed suspended ceiling structure of claim 12, wherein said plurality of secondary spoke members are connected to the midpoint of said plurality of intercostal members by use of fasteners.

16. The domed suspended ceiling structure of claim 13, wherein said tabs of said hub include a slot adapted to accept said splice plates.

17. The domed suspended ceiling structure of claim 12, wherein said hub includes a knockout adapted to allow for the passage of utility components.

18. The domed suspended ceiling structure of claim 12, wherein said tabs of said hub include an aperture adapted to accept hanger wire.

19. The domed suspended ceiling structure of claim 12, further including a plurality of cross tees, curved along their length and are connected between said primary spoke members and between said secondary spoke members and said primary spoke members.

20. A domed suspended ceiling system for creating a domed shaped ceiling comprising:

a central hub adapted to be suspended from a building structure with hangers, said hub including a plurality of spoke attachment points to provide moment connections positioned radially around said hub at predetermined angles;

a plurality of primary spoke members at least a portion of which are curved, said plurality of primary spoke members are connected to said spoke attachment points of said hub;

a plurality of intercostal members oriented to span between said plurality of primary spoke members and adapted to be fastened thereto;

a plurality of secondary spoke members, at least a portion of which are curved, said plurality of secondary spoke members are positioned between said plurality of primary spoke members and connected to said plurality of intercostal members;

a finishing layer applied to said plurality of primary spoke members, secondary spoke members and intercostal members to create a continuous domed surface.

21. The domed suspended ceiling system of claim 20, further including a plurality of splice plates adapted to connect said hub with said primary spoke members.

22. The domed suspended ceiling system of claim 21, wherein said splice plates allow for the interconnection of multiple primary spoke members.

23. The domed suspended ceiling system of claim 20, wherein said plurality of secondary spoke members are connected to the midpoint of said plurality of intercostal members by use of fasteners.

24. The domed suspended ceiling system of claim 21, wherein said spoke attachment points of said hub include a slot adapted to accept said splice plates.

25. The domed suspended ceiling system of claim 20, wherein said hub includes a knockout adapted to allow for the passage of utility components.

26. The domed suspended ceiling system of claim 20, wherein said spoke attachment points of said hub include apertures adapted to accept hanger wire.

27. The domed suspended ceiling system of claim 20 further including a plurality of cross tees curved along their length and are connected between said primary spoke members and between said secondary spoke members and said primary spoke members.

28. A domed suspended ceiling system for creating a domed shaped ceiling comprising:

an apex plate suspended from a building structure with hangers, said apex plate including a plurality of spoke attachment points positioned radially around said apex plate;

a plurality of spoke members at least a portion of which are curved said plurality of spoke members are suspended from the building structure with hangers and are connected to said spoke attachment points of said apex plate;

a plurality of cross tees having a first end and a second end, said plurality of cross tees positioned between said plurality of spoke members;

a finishing material applied to said plurality of spoke members and said plurality of cross tees to create a continuous domed surface.

29. The domed suspended ceiling system of claim 25, further including a plurality of splice plates adapted to connect said hub to said plurality of spoke members.

30. The domed suspended ceiling system of claim 27, wherein said hub includes a slot adapted to accept said splice plates.

31. The domed suspended ceiling system of claim 27, wherein said hub includes a knockout adapted to allow for the passage of utility components.

32. The domed suspended ceiling system of claim 27, wherein said spoke attachment points of said hub include apertures adapted to accept hanger wire.

* * * * *